US009289980B2

(12) United States Patent
Mori

(10) Patent No.: US 9,289,980 B2
(45) Date of Patent: Mar. 22, 2016

(54) POWER SOURCE CONTROL DEVICE FOR INKJET HEAD AND INKJET PRINTING APPARATUS

(71) Applicant: Konica Minolta, Inc., Chiyoda-ku, Tokyo (JP)

(72) Inventor: Masakazu Mori, Sagamihara (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/651,890

(22) PCT Filed: Dec. 6, 2013

(86) PCT No.: PCT/JP2013/082862
§ 371 (c)(1),
(2) Date: Jun. 12, 2015

(87) PCT Pub. No.: WO2014/092023
PCT Pub. Date: Jun. 19, 2014

(65) Prior Publication Data

US 2015/0314593 A1 Nov. 5, 2015

(30) Foreign Application Priority Data

Dec. 13, 2012 (JP) ..... 2012-272090

(51) Int. Cl.
*B41J 29/393* (2006.01)
*B41J 2/045* (2006.01)

(52) U.S. Cl.
CPC ..... *B41J 2/0457* (2013.01); *B41J 2/0455* (2013.01); *B41J 2/04501* (2013.01); *B41J 2/04548* (2013.01); *B41J 2/04551* (2013.01); *B41J 2/04555* (2013.01); *B41J 2/04586* (2013.01); *B41J 29/393* (2013.01)

(58) Field of Classification Search
CPC .. B41J 2/04548; B41J 2/0455; B41J 2/04551; B41J 2/04555; B41J 2/04501; B41J 29/393
See application file for complete search history.

(56) References Cited

U.S. PATENT DOCUMENTS 6,055,068 A * 4/2000 Abe ..... B41J 2/17546 347/3
6,330,069 B1 * 12/2001 Kim ..... B41J 29/393 358/1.14

(Continued)

FOREIGN PATENT DOCUMENTS

EP 1057652 A2 * 12/2000 ..... B41J 29/393
JP 11198495 A 7/1999

(Continued)

OTHER PUBLICATIONS

International Preliminary Report on Patentability corresponding to Application No. PCT/JP2013/082862; Date of Mailing: Jun. 16, 2015, with English translation.

(Continued)

*Primary Examiner* — Julian Huffman
(74) *Attorney, Agent, or Firm* — Cantor Colburn LLP

(57) ABSTRACT

The device and method handles increases in power consumed by an inkjet head. When greater-than-specified electric power is being input from both the first input section and the second input section, the control section controls the state of connection so as to prioritize connection of the second power source to the inkjet head driving system over the first power source.

8 Claims, 6 Drawing Sheets

(56) References Cited

U.S. PATENT DOCUMENTS

| | | | | |
|---|---|---|---|---|
| 2005/0057223 | A1* | 3/2005 | Harada | B41J 29/393 320/128 |
| 2007/0211096 | A1* | 9/2007 | Narushima | B41J 2/01 347/14 |

FOREIGN PATENT DOCUMENTS

| | | | |
|---|---|---|---|
| JP | 2002187263 | A | 7/2002 |
| JP | 2004195761 | A | 7/2004 |
| JP | 2009255335 | A | 11/2009 |
| JP | 2012201079 | A | 10/2012 |

OTHER PUBLICATIONS

Written Opinion of the International Searching Authority corresponding to Application No. PCT/JP2013/082862; Date of Mailing: Mar. 11, 2014.

International Search Report corresponding to Application No. PCT/JP2013/082862; Date of Mailing: Mar. 11, 2014, with English translation.

* cited by examiner

POWER SOURCE CONTROL DEVICE FOR INKJET HEAD AND INKJET PRINTING APPARATUS

TECHNICAL FIELD

The present invention relates to a power source control device for an inkjet head and an inkjet printing apparatus.

BACKGROUND ART

An inkjet printing apparatus is known that includes a plurality of power sources for driving inkjet heads as is disclosed in Patent Literature 1. The inkjet printing apparatus disclosed in Patent Literature 1 permits switching between a main power source and a battery-driven secondary power source for emergency use. The inkjet printing apparatus can switch from the main power source to the secondary power source in the event of a shutdown of electrical supply from the main power source.

PRIOR ART LITERATURES

Patent Literatures

PTL 1: Japanese Unexamined Patent Application Publication No. 2002-187263

DISCLOSURE OF INVENTION

Problems to be Solved by the Invention

In recent years, development of inkjet printing apparatuses with higher performance has resulted in inkjet heads with higher power consumption. Specifically, reasons for the growing power consumption of inkjet heads include an increase in electrical power to drive an increased number of nozzles in an inkjet head and improved operational productivity of an inkjet printing apparatus, i.e. a higher frequency of ejection cycles of ink droplets from each nozzle within a predetermined time interval. The maximum electric power supplied to the inkjet head should be increased to meet such an increase in power consumption.

A simple method for increasing the maximum electric power is replacement of the power source connected to the inkjet head with one having higher power supply capability. Unfortunately, the allowable peak current of lines (power lines) for supplying electrical power to an inkjet head is typically set to a maximum electric power expected at the time of development. Moreover, the power lines are connected to the inkjet head with a connector for connecting power lines. In other words, when the power source is simply replaced with another power source, the power lines must also be replaced with other power lines that accommodate peak current fed from the replaced power source. Replacement of the power lines, however, involves the replacement of a connection system including the connector. This results in enormous costs.

Such a disadvantage is more evident when the power lines are united with lines (signal lines) for transmitting control signals to drive the inkjet head and the power and the signal lines are connected to the inkjet head with a connector in an integrated manner.

A conventional inkjet printing apparatus equipped with a plurality of power sources merely switches from a main power source to a secondary power source in the event of a shutdown of electrical supply from the main power source.

Such an inkjet printing apparatus cannot control the switching between power sources in response to such an increase in power consumption.

It is an object of the present invention to provide a power source control device for an inkjet head that can deal with an increase in electrical power consumption of the inkjet head, and to provide an inkjet printing apparatus equipped with the inkjet head.

Means for Solving Problems

A power source control device for an inkjet head according to the invention recited in claim 1 includes a first input section which receives electrical power supplied from a first power source; a second input section which receives electrical power supplied from a second power source having higher power supply capability per predetermined time interval than the first power source; and a control section which controls a connection status between an inkjet head driving system and the first and second input sections such that any one of the first and second power sources is connected to the inkjet head driving system, wherein the control section controls the connection status in such a way as to connect the second power source, preferentially over the first power source, to the inkjet head driving system when a predetermined amount or more of electrical power is input from both the first and second input sections.

The invention recited in claim 2 is the power source control device for the inkjet head according to claim 1, wherein the control section preferentially connects the second power source to the inkjet head driving system when a detected voltage value based on a voltage value of the second power source is larger than a first voltage value.

The invention recited in claim 3 is the power source control device for the inkjet head according to claim 2, wherein the control section connects the first power source to the inkjet head driving system when the detected voltage value falls to or below a second voltage value while the second power source is being connected to the inkjet head driving system.

The invention recited in claim 4 is the power source control device for the inkjet head according to claim 3, wherein the first voltage value is larger than the second voltage value.

The invention recited in claim 5 is the power source control device for the inkjet head according to claim 3, wherein the detected voltage value is a value of voltage obtained by dividing voltage of the second power source using a voltage-dividing circuit, and the voltage-dividing circuit is capable of varying the detected voltage value.

The invention recited in claim 6 is the power source control device for the inkjet head according to any one of claims 1 to 5, wherein the control section preferentially connects the second power source to the inkjet head driving system when the control section receives information for permitting power source switching.

The invention recited in claim 7 is the power source control device for the inkjet head according to any one of claims 1 to 6, wherein the first input section is integrated with a line disposed between the inkjet head driving system and an operation control system which controls an operation of the inkjet head driving system.

An inkjet printing apparatus according to the invention recited in claim 8 includes the inkjet head driving system; and the power source control device for the inkjet head according to any one of claims 1 to 7.

Effects of the Invention

The present invention can deal with an increase in power consumption of an inkjet head.

BEST MODE TO CARRY OUT THE INVENTION

Figure 1:
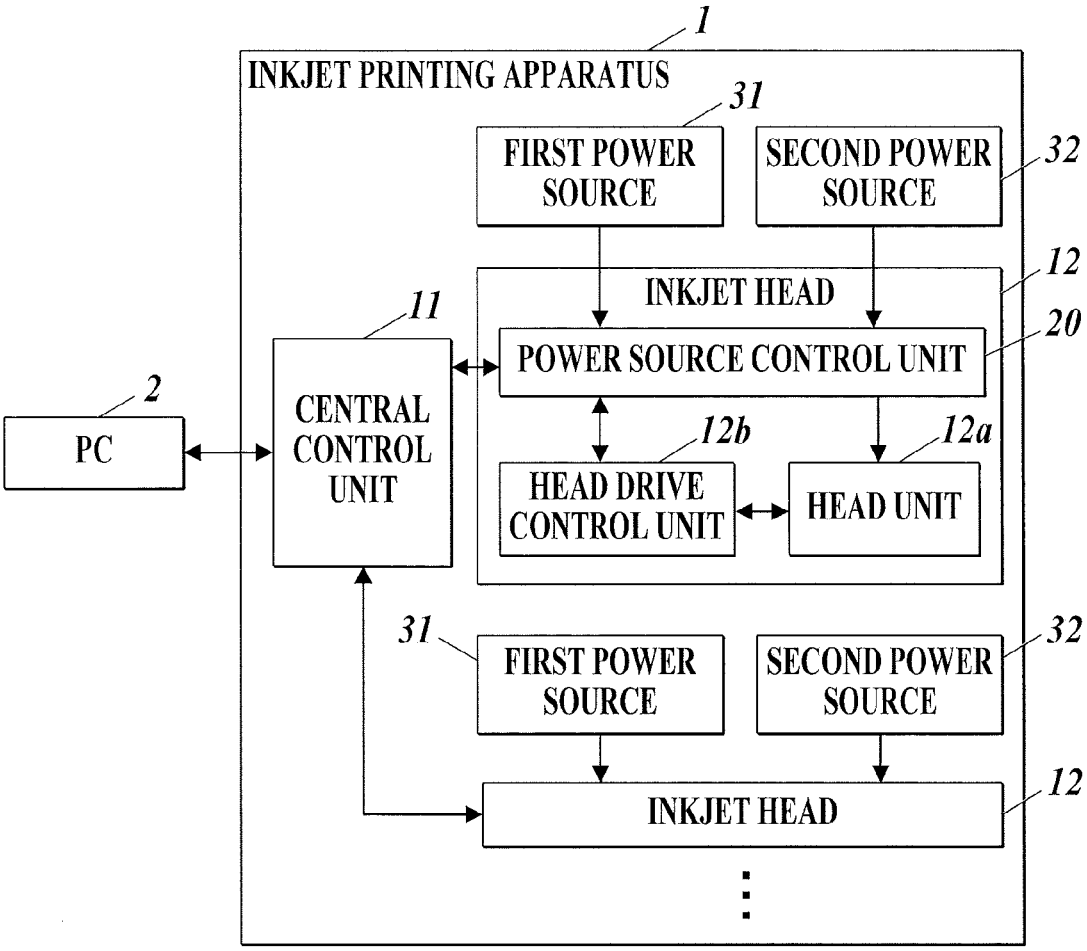
FIG. 1 is a block diagram of key components for controlling the operations of an inkjet head included in an inkjet printing apparatus.

An embodiment of the present invention will now be described with reference to the attached drawings. The embodiment described below includes various technically preferred limitations for accomplishing the present invention. The scope of the present invention, however, should not be limited to the embodiment and examples shown in the drawings.

FIG. 1 is a block diagram of key components for controlling the operations of an inkjet head 12 included in an inkjet printing apparatus 1.

The inkjet head 12 includes a head unit 12*a*, a head drive control unit 12*b*, and a power source control unit 20.

Components of the inkjet head 12 involved in formation of an image will now be described.

The head unit 12*a* ejects ink onto paper.

Specifically, the head unit 12*a* includes an inkjet head chip equipped with a plurality of nozzles for ejecting ink and a manifold for introducing ink to the inkjet head chip. The head unit 12*a* ejects ink supplied from an ink feeder (not shown) onto paper.

The head drive control unit 12*b* outputs driving signals to cause the head unit 12*a* to eject ink.

Specifically, the head drive control unit 12*b* is, for example, composed of a circuit, traces, and other electronic parts on a board installed inside the inkjet head 12. The head drive control unit 12*b* outputs signals for driving each nozzle of the head unit 12*a*.

Figure 2:
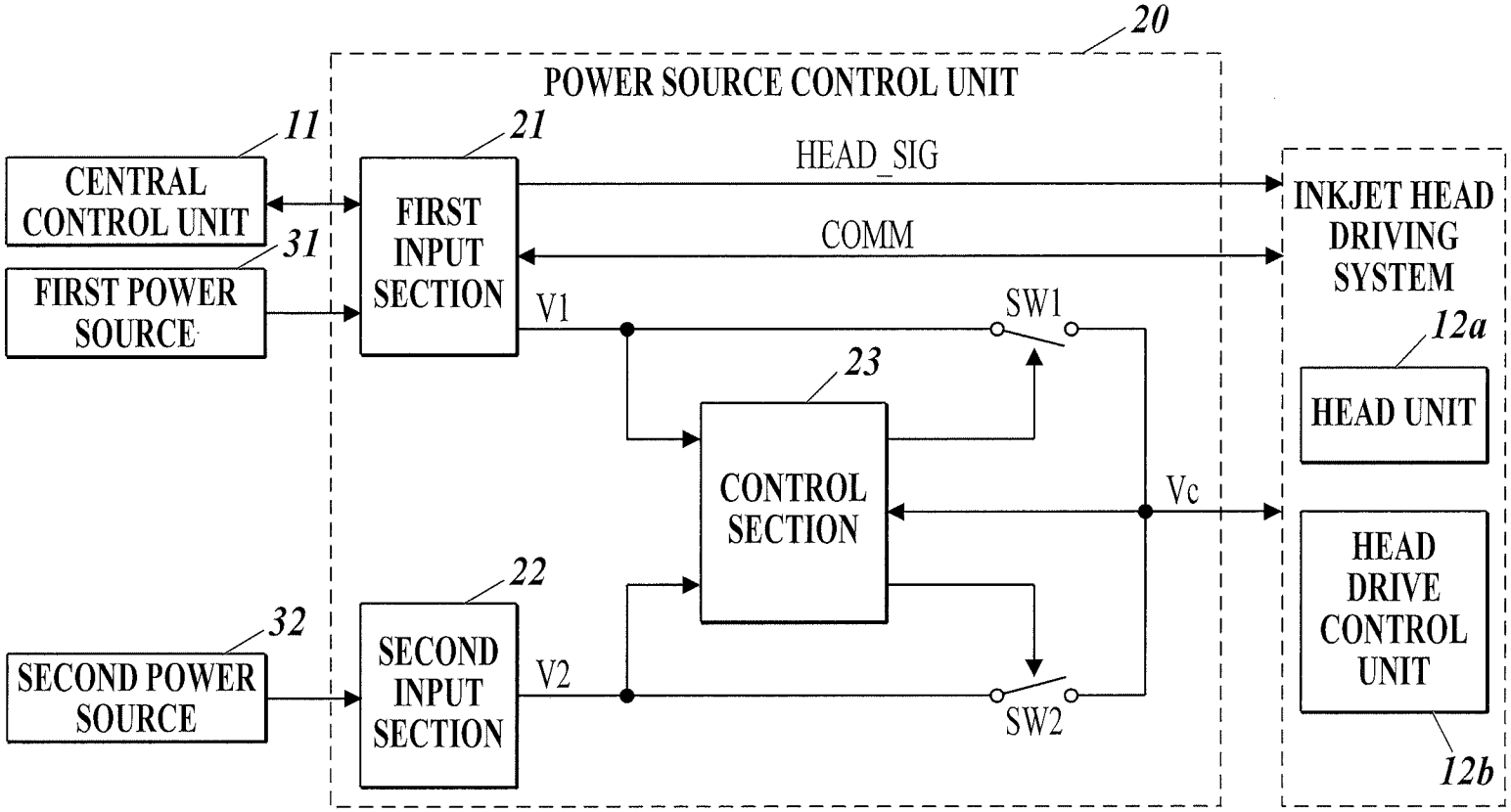
FIG. 2 is a diagram showing an example of a power source control unit in detail.

With reference to FIG. 2, the head drive control unit 12*b* is connected via the power source control unit 20 to a central control unit 11 in the inkjet printing apparatus 1. The head drive control unit 12*b* operates under the control of the central control unit 11. The central control unit 11 is connected to an external apparatus, such as a PC 2, via a communication device, a bus interface, or the like (not shown).

FIG. 1 illustrates only one inkjet head 12 which includes the head unit 12*a*, the head drive control unit 12*b*, and the power source control unit 20. Actually, however, the inkjet printing apparatus 1 includes a plurality of inkjet heads 12 each having the same configuration.

The PC 2 outputs data to the inkjet printing apparatus 1.

Specifically, the PC 2, for example, executes a printer driver for the inkjet printing apparatus 1 and processes image data through the printer driver so that the inkjet printing apparatus 1 produces a print record of the image data on a sheet of paper. More specifically, the PC 2 produces various pieces of data according to image data and outputs the produced data which is used to generate head driving data and ejection timing signals.

The central control unit 11 transfers data for driving each inkjet head 12 to the head drive control unit 12*b* according to the data output from the PC 2.

Specifically, the central control unit 11 buffers the data output from the PC2 and determines the timing for ejection of ink out of each inkjet head based on the buffered data, for example. Then, the central control unit 11 transfers head driving data and an ejection timing signal to each head drive control unit 12*b* at the determined ejection timing.

The head drive control unit 12*b* of the inkjet head 12 drives the head unit 12*a* in response to the data sent from the central control unit 11.

The inkjet printing apparatus 1 further includes an actuator for moving a carriage carrying the inkjet heads 12 along rails and a mechanical driver involved in the operations of various sensors for the operations of the inkjet printing apparatus 1, although these parts are not shown. The mechanical driver outputs feedback in response to a status detected by the sensors. The feedback is sent to the PC 2 via the central control unit 11. The PC 2 outputs data to the inkjet printing apparatus 1 according to image data as well as information on the inkjet printing apparatus 1, which is acquired by the feedback.

Components of the inkjet head 12 involved in power source control will now be described.

FIG. 2 is a diagram showing an example configuration of the power source control unit 20 in detail.

The power source control unit 20 includes a first input section 21, a second input section 22, a control section 23, switches SW1 and SW2, and lines connecting these components. Like the head drive control unit 12*b*, the power source control unit 20 is, for example, composed of a circuit and traces etc. on a board installed inside the inkjet head 12.

The head drive control unit 12*b* and the head unit 12*a* in the inkjet head 12 constitute an inkjet head driving system. The inkjet head driving system is connectable to either one of the first and second input sections 21 and 22 via a power line for transmission of electrical power depending on the connection status of the switches SW1 and SW2. The switches SW1 and SW2 can disconnect or connect the respective power lines between the respective input sections and the inkjet head driving system.

The first and second input sections 21 and 22 are terminals provided according to respective connectors of the power sources, for example, and act as lines connected to the power sources. The first and second input sections 21 and 22 receive electrical power from the respective power sources. In this embodiment, the power sources for supplying electrical power to the first and second input sections 21 and 22 are named a first power source 31 and a second power source 32, respectively.

The first and second power sources 31 and 32 supply electrical power that is compatible with the inkjet head driving system. The first and second power sources 31 and 32 in this embodiment are direct current power sources. The power sources may be of any type that can output electrical power compatible with the inkjet head driving system, other than these examples.

The second power source 32 has higher power supply capability per predetermined time interval than the first power source 31. Specifically, the capacities of the first and second power sources 31 and 32 are, for example, 24 watts and 75 watts, respectively. Alternatively, the first and second power sources 31 and 32 may have any output, other than these examples.

The first input section 21 is integrated with lines disposed between the inkjet head driving system and an operation control system that controls the operation of the driving system.

Specifically, the power source control unit 20 further includes a signal line HEAD_SIG and a signal line COMM between the first input section 21 and the inkjet head driving system. The signal line HEAD_SIG carries signals such as timing signals from the central control unit 11, which acts as an operation control system, to the inkjet head driving system. The signal line COMM carries various commands for communications between the central control unit 11 and the inkjet head driving system. A connector for connection to the first input section 21 bundles these signal lines and a power line for transmission of electrical power from the first power source 31 in an integrated manner such that all the lines are not short-circuited one another. Connection with this connector enables the supply of electrical power from the first power source 31 to the inkjet head driving system via the first input section 21 and transmission of various signals, commands, and other instructions between the central control unit 11 and the inkjet head driving system.

A connector for connection to the second input section 22 only supports a power line for transmission of electrical power from the second power source 32. Connection with this connector enables the second power source 32 to supply electrical power through the second input section 22. In other words, the second input section 22 and the line lying between the second input section 22 and the inkjet head driving system only serve as a power line for transmission of electrical power from the second power source 32 to the inkjet head driving system.

While the inkjet printing apparatus 1 is being activated, the inputs from the first input section 21 are always stable. In other words, while the inkjet printing apparatus 1 is being activated, the central control unit 11 can communicate with the inkjet head driving system, and a predetermined amount or more of electrical power within the capacity of the first power source 31 can enter the first input section 21 from the first power source 31.

In contrast, the input from the second input section 22 depends on the status of the second power source 32. The second power source 32 is, for example, connected to not only one inkjet head driving system but also operating parts or other power consuming devices (not shown) in the inkjet printing apparatus 1. The amount of electrical power supplied to the inkjet head driving system can fluctuate depending on the operating states of these devices.

The control section 23 controls the connection status between the inkjet head driving system and the first and second input sections 21 and 22 such that the inkjet head driving system is connected to either one of the first and second power sources 31 and 32.

Specifically, the control section 23 turns on either one of the switches SW1 and SW2 and turns off the other of the switches SW1 and SW2 so as to connect the power source corresponding to the input section, which has been connected to the inkjet head driving system via the turned-on switch, to the driving system. Under the control of the connection status by the control section 23, the inkjet head driving system operates by receiving electrical power from either one of the first and second power sources 31 and 32.

Figure 3:
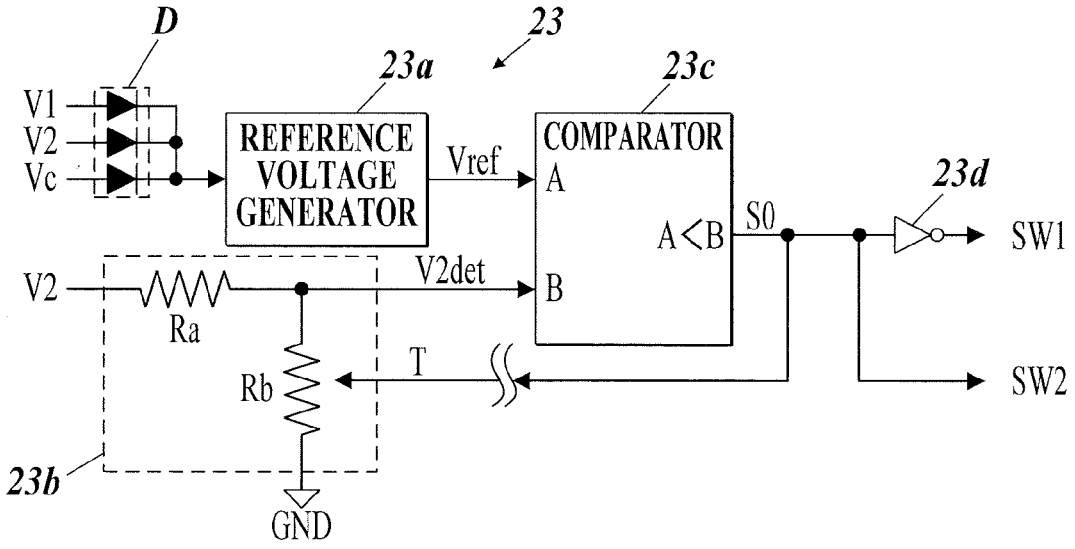
FIG. 3 shows an example of a circuit configuration of a control section.

FIG. 3 shows an example of the circuit configuration of the control section 23.

With reference to FIG. 3, the control section 23 includes a reference voltage generator 23*a*, a voltage-dividing circuit 23*b*, and a comparator 23*c* to provide the control of connection status.

The reference voltage generator 23*a* outputs a reference voltage Vref to the comparator 23*c*.

Specifically, the reference voltage generator 23*a* applies the predetermined reference voltage Vref to a first input section A of the comparator 23*c* in response to application of any one of a voltage V1 of the first power source 31 applied via the first input section 21, a voltage V2 of the second power source 32 applied via the second input section 22, and a voltage Vc of a power source connected to the driving system. The voltage Vc is either the voltage V1 of the first power source 31 applied via the first input section 21 or the voltage V2 of the second power source 32 applied via the second input section 22.

More specifically, the reference voltage generator 23*a*, for example, includes a regulator that outputs a constant voltage regardless of the level of a voltage applied from the outside. Thus, the reference voltage generator 23*a* outputs the reference voltage Vref with a predetermined value.

In the example shown in FIG. 3, three power lines for the voltage V1 of the first power source 31 applied via the first input section 21, the voltage V2 of the second power source 32 applied via the second input section 22, and the voltage Vc of a power source connected to the driving system are connected to the reference voltage generator 23*a* via their respective diodes D. This configuration may be replaced with any other arrangement. For example, only two power lines and two diodes D may be provided for the voltage V1 of the first power source 31 and the voltage V2 of the second power source 32.

The voltage-dividing circuit 23*b* produces a detected voltage V2det based on the voltage of the second power source 32 and outputs the voltage V2det to the comparator 23*c*.

Specifically, with reference to FIG. 3, the voltage-dividing circuit 23*b* is disposed between wiring for the incoming voltage V2, i.e. the second input section 22, and the comparator 23*c*. The voltage-dividing circuit 23*b* includes two resistors. A first resistor Ra of the two resistors is disposed on a line between the second input section 22 and a second input section B of the comparator 23*c*. A second resistor Rb of the two resistors is disposed on a line between a line running from the first resistor Ra to the second input section B and a ground GND.

The value of the detected voltage V2det applied to the second input section B of the comparator 23*c* through the voltage-dividing circuit 23*b* is determined by the resistance values of the two resistors Ra and Rb in the voltage-dividing circuit 23*b*.

Specifically, the value of the detected voltage V2det applied to the second input section B of the comparator 23*c* is calculated by Expression (1):

$$V2\text{det}=\{Rb/(Ra+Rb)\}\times V2 \quad (1)$$

where V2 represents the value of the voltage V2 of the second power source 32 applied via the second input section 22, and Ra and Rb represent the resistance values of the two resistors Ra and Rb, respectively, in the voltage-dividing circuit 23*b*.

As described above, the value of the detected voltage V2det is the value of voltage obtained by dividing the voltage V2 with the voltage-dividing circuit 23*b*, where the voltage V2 is input from the second power source 32 via the second input section.

The second resistor Rb in this embodiment is, for example, a variable resistor. Thus, the second resistor Rb has a variable resistance value. As shown in Expression (1), as the resistance value of the second resistor Rb varies, the calculated detected voltage V2det also varies. In other words, the voltage-dividing circuit 23*b* can vary the value of the detected voltage V2det.

The comparator 23*c* makes a comparison between the reference voltage Vref and the detected voltage V2det.

Specifically, the comparator 23*c*, for example, includes a comparator that makes an output in response to the result of a comparison between two input voltages. The comparator 23*c* compares the value of the reference voltage Vref applied to the first input section A with the value of the detected voltage V2det applied to the second input section B. If the value of the detected voltage V2det is larger than the value of the reference voltage Vref, the comparator 23*c* outputs a signal S0 from its output section. If the value of the detected voltage V2det is smaller than or equal to the value of the reference voltage Vref, the comparator 23*c* outputs no signal S0.

The output section of the comparator 23*c* is connected via a NOT circuit 23*d* to the switch SW1 for connecting the first input section 21 with the inkjet head driving system. The output section of the comparator 23*c* is also connected via a branch point, which is located between the NOT circuit 23*d* and the output section, to the switch SW2 for connecting the second input section 22 with the inkjet head driving system.

The signal S0 output from the comparator 23*c* acts as a command to turn on a connected switch. In other words, a switch that has received the signal S0 is connected, and a switch that has received no signal S0 is disconnected.

When the comparator 23*c* outputs a signal S0 in response to the comparative result between the reference voltage Vref and the detected voltage V2det, the switch SW2 receives the signal S0 and maintains the connection. As a result, electrical power is supplied from the second power source 32 through the second input section 22 into the inkjet head driving system. At this time, the switch SW1, which is connected to the comparator 23*c* via the NOT circuit 23*d*, receives no signal S0 and severs connection. As a result, no electrical power is supplied from the first power source 31 to the inkjet head driving system.

As described above, if the value of the detected voltage V2det based on the voltage value of the second power source 32 is larger than the value of the reference voltage Vref (first voltage value), the control section 23 preferentially connects the second power source 32 to the inkjet head driving system.

When the comparator 23*c* outputs no signal S0, the switch SW2 receives no signal S0 and is disconnected. Thus, no electrical power is supplied from the second power source 32 to the inkjet head driving system. At this time, the switch SW1, which is connected to the comparator 23*c* via the NOT circuit 23*d*, maintains connection because the switch SW1 receives a command indicating "presence of the signal S0 input" that is opposite to "no signal S0 input". As a result, electrical power is supplied from the first power source 31 through the first input section 21 into the inkjet head driving system.

The reference voltage Vref is predetermined to be such a value as to check whether electric power supplied from the second power source 32 through the second input section 22 exceeds the electrical power from the first input section 21 determined within the capacity of the first power source 31 (the "predetermined amount or more of electrical power" described above). In other words, while the comparator 23*c* is outputting the signal S0, the predetermined amount or more of electrical power is always supplied from the second power source 32 through the second input section 22.

Thus, while the predetermined amount or more of electrical power is being supplied through both the first and second input sections 21 and 22, the control section 23 controls the connection status between the inkjet head driving system and the first and second input sections 21 and 22 in such a way as to connect the second power source 32, preferentially over the first power source 31, to the inkjet head driving system.

When the second power source 32 is connected to the inkjet head driving system, the voltage-dividing circuit 23*b* is controlled so as to increase the value of the detected voltage V2det.

Specifically, the voltage-dividing circuit 23*b* is controlled such that the resistance value of the second resistor Rb increases in response to a signal T output in response to the signal S0 output from the comparator 23*c*. As a result, the value of the detected voltage V2det, which is determined by Expression (1), increases.

The head drive control unit 12*b* performs operations involved in the control of the voltage-dividing circuit 23*b* to increase the value of the detected voltage V2det, for example. The operation may be performed with any unit, other than the head drive control unit 12*b*, that can detect the establishment of connection between the second power source 32 and the inkjet head driving system.

If the second power source 32 is connected to the inkjet head driving system and if the value of the detected voltage V2det falls to or below a second voltage value, the control section 23 connects the first power source 31 to the inkjet head driving system.

Specifically, the value of the voltage V2 of the second power source 32 applied via the second input section 22 decreases due a reason of, for example, the second power source 32 supplying electrical power to a plurality of devices. The value of the detected voltage V2det also decreases in response to such a decrease in voltage V2 value.

The voltage-dividing circuit 23*b* causes the value of the detected voltage V2det to be larger while the second power source 32 is being connected to the inkjet head driving system than before the establishment of connection between the second power source 32 and the inkjet head driving system. Thus, with reference to FIG. 4, while the second power source 32 is being connected to the inkjet head driving system, that is, from a timing t1 when the value of the detected voltage V2det exceeds the value of the reference voltage Vref to a timing t2 when the value of the detected voltage V2det falls to or below the value of the reference voltage Vref, the value of the detected voltage V2det has a margin M relative to the value of the reference voltage Vref. As long as a decrease in the voltage V2 value of the second power source 32 is within the level corresponding to the margin M, the value of the detected voltage V2det does not fall to or below the value of the reference voltage Vref.

When a decrease in the voltage V2 value of the second power source 32 is greater than a level corresponding to the margin M, the value of the detected voltage V2det falls to or below the value of the reference voltage Vref. In this case, the comparator 23*c* outputs no signal S0. As a result, the switch SW2 is disconnected whereas the switch SW1 is connected. Thus, the connection between the second power source 32 and the inkjet head driving system is severed, and the first power source 31 is connected to the inkjet head driving system.

In other words, when the value of the detected voltage V2det falls to or below the value of the reference voltage Vref (second voltage value) while the second power source 32 is being connected to the inkjet head driving system, the control section 23 connects the first power source 31 to the inkjet head driving system. As described above, in this embodiment, the value of the reference voltage Vref acts as the first voltage value and the second voltage value.

When the first power source 31 is connected to the inkjet head driving system, the voltage-dividing circuit 23*b* is controlled so that the second resistor Rb has a resistance value that the second resistor Rb marked before the establishment of connection between the second power source 32 and the inkjet head driving system.

After that, when the value of the detected voltage V2det exceeds the value of the reference voltage Vref again, the second power source 32 is reconnected to the inkjet head driving system and the value of the detected voltage V2det has the margin M. The control section 23 controls a connection status between the power sources and the inkjet head driving system during the operation of the inkjet printing apparatus 1.

The inkjet printing apparatus 1 according to this embodiment controls the connection status in such a way as to connect the second power source 32, preferentially over the first power source 31, to the inkjet head driving system when a predetermined amount or more of electrical power is supplied through both the first and second input sections 21 and 22. Thus, when both of the power sources can supply the predetermined amount or more of electrical power, the inkjet printing apparatus 1 preferentially uses the second power source 32 having the higher power supply capability. As a result, the inkjet printing apparatus 1 according to this embodiment can carry out power supply with the second power source 32, dealing with an increase in power consumption of an inkjet head.

The second power source 32 is preferentially connected to the inkjet head driving system if the value of the detected voltage V2det exceeds the value of the reference voltage Vref acting as the first voltage value. Thus, the reference voltage Vref can be used to determine whether or not electrical power supplied from the second power source 32 via the second input section 22 is adequate. As a result, the second power source 32 can always supply adequate electrical power while preference is being given to the second power source 32.

If the value of the detected voltage V2det falls to or below the value of the reference voltage Vref acting as the second voltage value while the second power source 32 is being connected to the inkjet head driving system, the first power source 31 is connected to the inkjet head driving system. If electrical power from the second power source 32 becomes insufficient after establishment of the connection between the second power source 32 and the inkjet head driving system, the power sources can be switched so that the first power source 31 supplies electrical power to the inkjet head driving system. As a result, highly stable electrical power can be supplied to the inkjet head driving system.

The value of the detected voltage V2det is a value based on the voltage of the second power source 32 and obtained downstream of the voltage-dividing circuit 23*b*. The voltage-dividing circuit 23*b* can vary the value of the detected voltage V2det. Thus, as described above, the value of the detected voltage V2det varies depending on whether the second power source 32 is connected or disconnected to or from the inkjet head driving system. Consequently, as the connection of the second power source 32 is controlled using the value of the reference voltage Vref, there is a margin M between the value of the detected voltage V2det as the criterion for connection and the value of the detected voltage V2det as the criterion for disconnection. As a result, hysteresis can be provided between the first voltage value acting as the criterion for connection and the second voltage value acting as the criterion for disconnection. Thus, as for the voltage value of the second power source 32, requirements on the second power source 32 for disconnection can be relaxed compared to requirements on the second power source 32 for establishment of connection.

Figure 4:
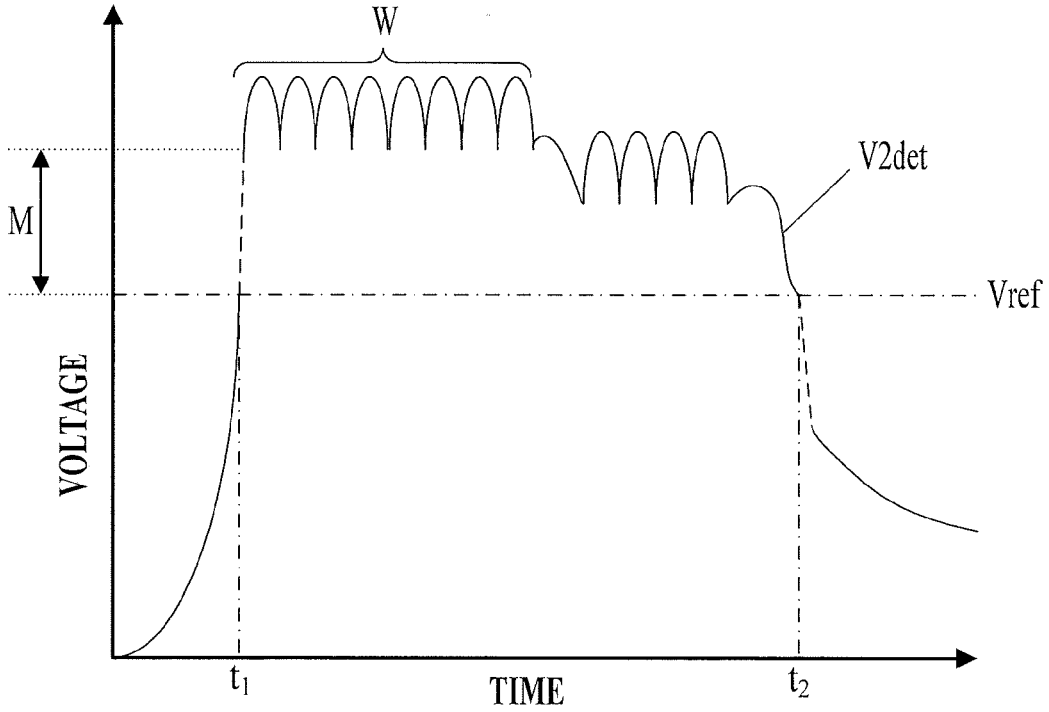
FIG. 4 is a graph schematically showing an example of the relationship among the varying detected voltage, a reference voltage, and control of a connection status.

With reference to FIG. 4, it is assumed that the value of DC voltage supplied from the second power source 32 traces a waveform W in which the voltage repeatedly moves upward and downward in a predetermined time cycle. Now, let us suppose that the value of the reference voltage Vref for establishing connection of the second power source 32 with the inkjet head driving system is identical to the value of the reference voltage Vref for severing the connection, and that the voltage-dividing circuit 23*b* does not vary the value of the detected voltage V2det. Under the supposed conditions, the connection is severed when the value of the detected voltage V2det falls to or below the value of the reference voltage Vref due to a fall in the voltage value in the waveform W and the connection is established when the value of the detected voltage V2det exceeds the value of the reference voltage Vref due to a rise in the voltage value in the waveform W. Such changes in the connection status may be repeated. As a result, the second power source 32 cannot supply stable electrical power. In contrast, in this embodiment, the signal T is output in response to the output of the signal S0 when the value of the detected voltage V2det exceeds the value of the reference voltage Vref (timing t1), and the value of the detected voltage V2det increases in response to the output of the signal T. The signal T is lost in response to disappearance of the signal S0 when the value of the detected voltage V2det falls to or below the value of the reference voltage Vref (timing t2), and the value of the detected voltage V2det decreases in response to the disappearance of signal T. In other words, from the timing t1 to the timing t2, the change in value of the detected voltage V2det made by the voltage-dividing circuit 23*b* creates a margin M. The margin M prevents the waveform W from causing repeated connection and disconnection cycles. As a result, the second power source 32 can supply stable electrical power.

The first input section 21 is integrated with lines disposed between the inkjet head driving system and the operation control system that controls the operation of the driving system. Thus, the lines and the power line for transmission of electrical power from the first power source 31 can be connected to the inkjet head in an integrated manner.

If a second power source 32, a second input section 22 and a power line for transmission of electrical power from the second power source 32 to the inkjet head driving system, a control section 23, and two switches SW1 and SW2 are provided to a conventional inkjet head including a power line for transmission of electrical power from a first power source 31 and lines disposed between an inkjet head driving system and an operation control system that controls the operation of the driving system in an integrated manner, the second power source 32 can be preferentially connected to the conventional inkjet head. Thus, the conventional inkjet head can be equipped with a power source capable of supplying larger electric power to the inkjet head at a low cost.

(Variation)

Figure 5:
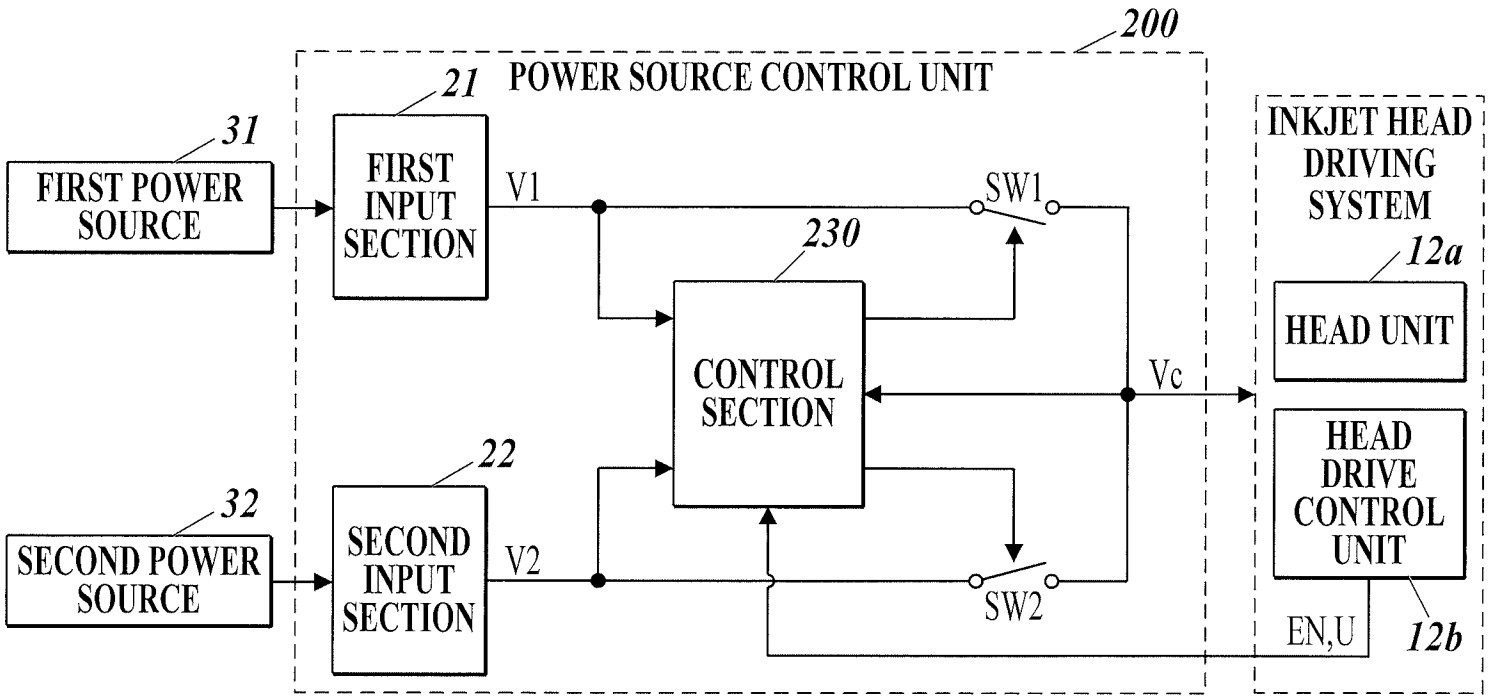
FIG. 5 is a diagram showing a variation of the power source control unit in detail.

A variation in accordance with the present invention will now be described with reference to FIGS. 5 and 6.

In addition to the components of the control section 23 in the embodiment described above, a control section 230 in a power source control unit 200 according to the variation includes an AND circuit 23*e*, an OR circuit 23*f*, and lines for receiving signals EN and U from the head drive control unit 12*b*. Structural elements other than the power source control unit 200 in an inkjet printing apparatus according to the variation are similar to those of the embodiment described above. Thus, redundant descriptions on the similar elements are omitted.

A first input section 21 of the variation is not provided with lines such as the signal lines HEAD_SIG and COMM disposed between the inkjet head driving system and the operation control system that controls the operation of the driving system in the embodiment described above. The variation may, however, include such lines as in the embodiment described above. If the first input section 21 includes no such lines, a connection corresponding to the lines should be separately provided. For example, the central control unit 11 may be directly connected with the head drive control unit 12*b*.

The AND circuit 23*e* outputs a signal S1 from its output section if the AND circuit 23*e* receives both a signal S0 from an output section of a comparator 23*c* and the signal EN from the head drive control unit 12*b*.

The OR circuit 23*f* outputs a signal S2 from its output section if the OR circuit 23*f* receives at least one of the signal S1 output from the AND circuit 23*e* and the signal U output from the head drive control unit 12*b*.

Figure 6:
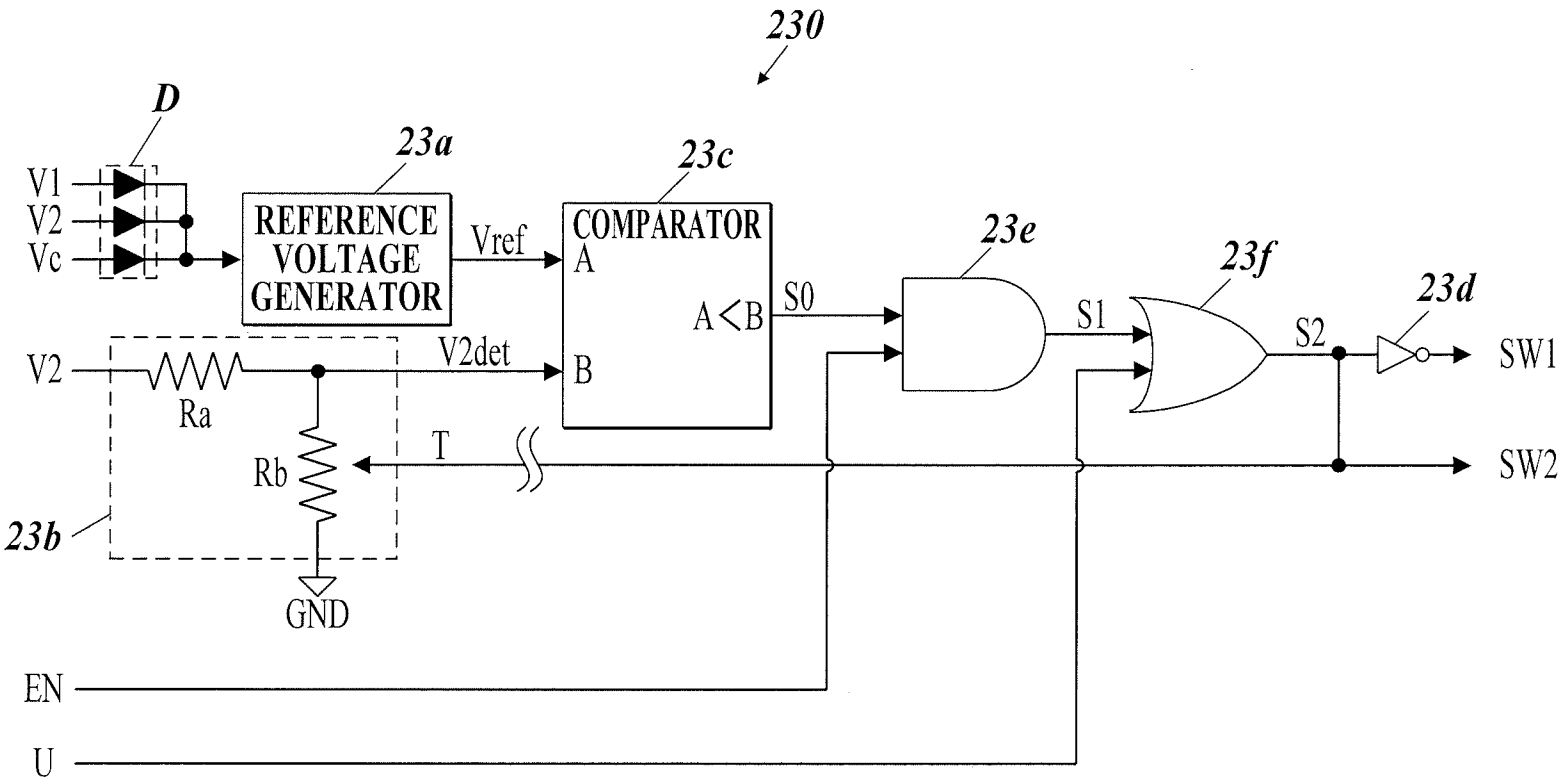
FIG. 6 shows an example of a circuit of a control section included in the variation.

With reference to FIG. 6, in the variation, the output section of the OR circuit 23*f* is connected to switches SW1 and SW2. A NOT circuit 23*d* is disposed between the output section of the OR circuit 23*f* and the switch SW1, as in the embodiment described above. In the variation, the signal S2 acts as a command to turn on a connected switch. In the variation, a signal T for increasing the resistance value of a second resistor Rb is output in response to the signal S2.

The control section 230 according to the variation preferentially connects the second power source 32 to the inkjet head driving system if the control section 230 receives information which permits power source switching.

Specifically, the control section 230 preferentially connects the second power source 32 to the inkjet head driving system if the head drive control unit 12*b* outputs an enable signal EN indicating permission of the power source switching.

More specifically, the AND circuit 23*e* outputs the signal S1 if the AND circuit 23*e* receives both the signals S0 and EN. Thus, in order to determine whether to output the signal S1 depending on the presence or absence of the signal S0, the signal EN needs to be output. In other words, if the control section receives the signal EN serving as information for permitting power source switching, the control section controls the connection status of the switches SW1 and SW2 in response to the output from the comparator 23*c* to preferentially connect the second power source 32 to the inkjet head driving system.

The AND circuit 23*e* outputs no signal S1 if the AND circuit 23*e* receives no signal EN. In other words, the control section 230 does not exercise control in response to the output from the comparator 23*c* without receiving the signal EN.

The OR circuit 23*f* outputs the signal S2 when the OR circuit 23*f* receives at least one of the signal S1 output from the AND circuit 23*e* and the signal U output from the head drive control unit 12*b*. Thus, when the signal EN is received, the OR circuit 23*f* outputs the signal S2 in response to the signal S1 output from the AND circuit 23*e*.

The variation further allows the second power source 32 to be preferentially connected to the inkjet head driving system with the signal U.

Specifically, the OR circuit 23*f* outputs the signal S2 if the OR circuit 23*f* receives the signal U. Thus, as long as the OR circuit 23*f* receives the signal U, the control section 230 preferentially connects the second power source 32 to the inkjet head driving system.

Conditions for outputting the signals EN and U are appropriately defined.

For example, the signal EN may be output in principle during the operation of the inkjet printing apparatus 1. Alternatively, the generation of the signal EN may be disabled if the inkjet head 12 malfunctions for some reason. Instead, the central control unit 11 may control whether or not to output the signal EN. If the driving system of the inkjet head 12 performs an operation which consumes much electrical power that may exceed the power supply from the first power source 31, the central control unit 11 may cause the signal EN to be output. The operation of the inkjet head 12 which consumes much electrical power is, for example, print of a solid filled area by many nozzle actions, which increases power consumption.

If no electrical power is supplied from the first power source 31 due to a malfunction in the first power source 31 or any other reason, the signal U may be output so as to make the use of the second power source 32 fixed.

In addition to the advantages of the embodiment described above, the second power source 32 is preferentially connected to the inkjet head driving system if the signal EN is received, the signal EN serving as information for permitting power source switching. Thus, another condition can be added to the condition concerning input of a predetermined amount or more of electrical power from the second input section 22, and the signal EN can be output in response to satisfaction of the added condition. The satisfaction of the added condition can thus be associated with the preference for the second power source 32. As a result, the variation allows a more flexible setting of conditions for the control of preferentially connecting the second power source 32 to the inkjet head driving system.

The embodiments of the present invention described above are illustrative examples in all respects and should not be construed as limiting the present invention. The scope of the present invention is defined not by the description given above but by the claims and is intended to include all the variations within the meaning and scope of the claims and their equivalents.

For example, the circuits of the control sections 23 and 230 in the embodiment and the variation described above as examples may be replaced with any other circuits. Other examples of the units will now be described.

Figure 7:
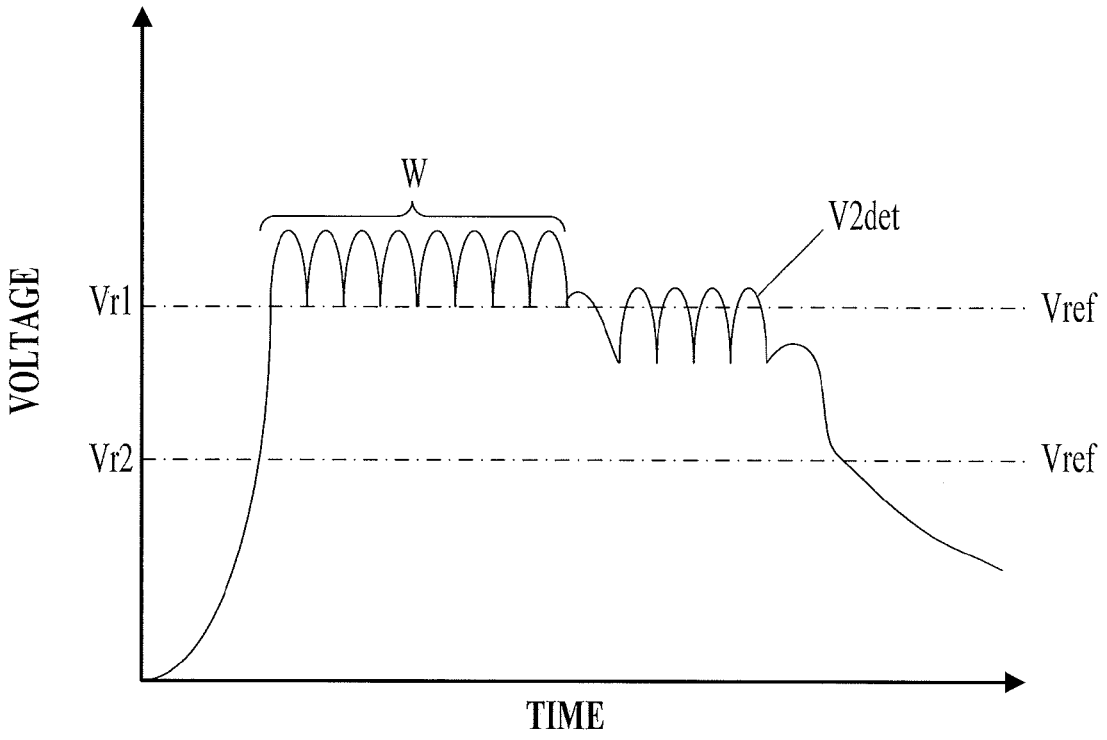
FIG. 7 is a graph schematically shows another example of the relationship among the varying detected voltage, reference voltages, and control of a connection status.

For example, in the embodiment and the variation described above, both the first and second voltage values are represented as the values of the reference voltages Vref, and the voltage-dividing circuit 23*b* can vary the value of the detected voltage V2det such that the lower limit of the value of the voltage V2 of the second power source 32, at which connection of the second power source 32 with the inkjet head driving system is severed, is essentially lower than the value of the voltage V2, at which connection of the second power source 32 with the inkjet head driving system is established. Instead, any embodiment may be used, other than these examples. For example, in another embodiment, the value of the reference voltage Vref output from the reference voltage generator 23*a* may vary such that the value of the reference voltage Vref corresponds to either the first or second voltage value, depending on whether or not the second power source 32 is connected to the inkjet head driving system. In this case, the reference voltage generator 23*a* includes a variable regulator or any other component that can vary the output voltage value. The reference voltage generator 23*a* varies the output voltage value with the variable regulator so as to vary the value of the reference voltage Vref depending on whether or not the second power source 32 is connected to the inkjet head driving system. In other words, the value of the reference voltage Vref is a first voltage value while the second power source 32 is being disconnected to the inkjet head driving system whereas the value of the reference voltage Vref is a second voltage value while the second power source 32 is being connected to the inkjet head driving system. In this case, with reference to FIG. 7, the reference voltage generator 23*a* is controlled such that the value of the reference voltage Vref corresponding to the first voltage value (Vr1) is larger than the value of the reference voltage Vref corresponding to the second voltage value (Vr2).

If the value of the voltage output from the reference voltage generator 23*a* varies so as to correspond to the first or second voltage value as described above, control on the voltage-dividing circuit 23*b* to vary the resistance value of the second resistor Rb in the embodiment and the variation described above is not necessary. In this case, the voltage-dividing circuit 23*b* may be omitted.

As described above, this embodiment provides hysteresis between the first voltage value acting as a criterion for connection and the second voltage value acting as a criterion for disconnection as in the embodiment and the variation described above, with the proviso that the value of the reference voltage Vref corresponding to the first voltage value is larger than the value of the reference voltage Vref corresponding to the second voltage value. In addition, control of the detected voltage V2det through the voltage-dividing circuit 23*b* and the voltage-dividing circuit 23*b* itself can be omitted.

The resistors Ra and Rb in the voltage-dividing circuit 23*b* according to the embodiment and the variation described above are illustrative examples and may be replaced with any combination of other resistors having resistance values for a suitable value of the detected voltage V2det. For example, the resistors Ra and Rb each may be two or more resistors connected in series.

The variation may exclude the OR circuit 23*f* and may control the connection status in response to the signal S1 output from the AND circuit 23*e*.

In the embodiment and the variation described above, the power source control units 20 and 200 each include the switches SW1 and SW2. This example configuration may be replaced with any other arrangement. For example, the control sections 23 and 230 each may control a switch section disposed outside the power source control unit 20 such that the switch section switches a connection status between the inkjet head driving system and the first and second input sections 21 and 22. The power source control unit 20 may be disposed outside the inkjet head.

The PC2 in the embodiment and the variation described above is an example device that outputs data to the inkjet printing apparatus 1 but may be replaced with any other device. For example, the inkjet printing apparatus 1 may include such a configuration corresponding to functions, which are otherwise performed by the PC2 through read-out of the printer driver in the embodiment and the variation described above.

INDUSTRIAL APPLICABILITY

The present invention can be applied to a power source control device for an inkjet head and an inkjet printing apparatus.

REFERENCE NUMERALS

1 inkjet printing apparatus
2 PC
11 central control unit
12 inkjet head
12*a* head unit
12*b* head drive control unit
20 and 200 power source control unit
21 first input section
22 second input section
23 and 230 control section
23*a* reference voltage generator
23*b* voltage-dividing circuit
23*c* comparator
23*d* NOT circuit
31 first power source
32 second power source
SW1 and SW2 switch

The invention claimed is:

1. A power source control device for an inkjet head, comprising:

a first input section which receives electrical power supplied from a first power source;

a second input section which receives electrical power supplied from a second power source having higher power supply capability per predetermined time interval than the first power source; and a control section which controls a connection status between an inkjet head driving system and the first and second input sections such that any one of the first and second power sources is connected to the inkjet head driving system, wherein the control section controls the connection status in such a way as to connect the second power source, preferentially over the first power source, to the inkjet head driving system when a predetermined amount or more of electrical power is input from both the first and second input sections.

2. The power source control device for the inkjet head according to claim 1, wherein the control section preferentially connects the second power source to the inkjet head driving system when a detected voltage value based on a voltage value of the second power source is larger than a first voltage value.

3. The power source control device for the inkjet head according to claim 2, wherein the control section connects the first power source to the inkjet head driving system when the detected voltage value falls to or below a second voltage value while the second power source is being connected to the inkjet head driving system.

4. The power source control device for the inkjet head according to claim 3, wherein the first voltage value is larger than the second voltage value.

5. The power source control device for the inkjet head according to claim 3, wherein the detected voltage value is a value of voltage obtained by dividing voltage of the second power source using a voltage-dividing circuit, and the voltage-dividing circuit is capable of varying the detected voltage value.

6. The power source control device for the inkjet head according to claim 1, wherein the control section preferentially connects the second power source to the inkjet head driving system when the control section receives information for permitting power source switching.

7. The power source control device for the inkjet head according to claim 1, wherein the first input section is integrated with a line disposed between the inkjet head driving system and an operation control system which controls an operation of the inkjet head driving system.

8. An inkjet printing apparatus comprising:

the inkjet head driving system; and the power source control device for the inkjet head according to claim 1.

* * * * *